US009785178B1

(12) United States Patent
BenSaleh et al.

(10) Patent No.: US 9,785,178 B1
(45) Date of Patent: Oct. 10, 2017

(54) PRECISION CURRENT REFERENCE GENERATOR CIRCUIT

(71) Applicant: King Abdulaziz City for Science and Technology, Riyadh (SA)

(72) Inventors: Mohammed Sulaiman BenSaleh, Riyadh (SA); Syed Arsalan Jawed, Karachi (PK); Yasir Mehmood Siddiqi, Karachi (PK); Abdulfattah Mohammad Obeid, Riyadh (SA); Ahmed Kassem, Riyadh (SA); Shahab Ahmed Najmi, Riyadh (SA); Syed Manzoor Qasim, Riyadh (SA)

(73) Assignee: KING ABDULAZIZ CITY FOR SCIENCE AND TECHNOLOGY, Riyadh (SA)

( * ) Notice: Subject to any disclaimer, the term of this patent is extended or adjusted under 35 U.S.C. 154(b) by 0 days.

(21) Appl. No.: 15/072,394

(22) Filed: Mar. 17, 2016

(51) Int. Cl.
*G05F 3/20* (2006.01)
*G05F 3/26* (2006.01)

(52) U.S. Cl.
CPC ..... *G05F 3/26* (2013.01)

(58) Field of Classification Search
CPC ... G05F 3/245; G05F 3/08; G05F 3/16; G05F 3/20; G05F 3/24; G05F 3/242; G05F 3/30; G05F 1/563
USPC ..... 323/304, 311–317, 266
See application file for complete search history.

(56) References Cited

U.S. PATENT DOCUMENTS 5,760,639 A * 6/1998 Hall ..... G05F 3/30 323/314
6,294,962 B1 9/2001 Mar
6,448,811 B1 9/2002 Narendra et al.
6,774,666 B1 8/2004 Samad
6,870,418 B1 * 3/2005 Tang ..... G05F 3/30 327/513
7,288,983 B1 * 10/2007 Schwartsglass ..... G05F 3/08 327/513
7,301,316 B1 11/2007 Pham
7,456,678 B2 11/2008 Passerini et al.
7,728,630 B1 6/2010 Ren et al.
(Continued)

FOREIGN PATENT DOCUMENTS

IN 2012MU02000 A 2/2014

OTHER PUBLICATIONS

Blauschild, "WP 3.5: An Integrated Time Reference", IEEE International Solid-State Circuits Conference, ISSCC94/Session 3/Analog Techniques/Paper WP 3.5, 1994, pp. 56-57.
Zhai et al, "Detection of On-Chip Temperature Gradient Using a 1.5V Low Power CMOS Temperature Sensor"; ISCAS 2006; 2006; pp. 1171-1174.
Bethi et al, "A Temperature and Process Insensitive CMOS Reference Current Generator", IEEE 56th International Midwest Symposium on Circuits & Systems, 2013, pp. 301-304.
(Continued)

*Primary Examiner* — Alex Torres-Rivera
(74) *Attorney, Agent, or Firm* — Andrew M. Calderon; Roberts Mlotkowski Safran Cole & Calderon, P.C.

(57) ABSTRACT

A current reference generator includes a first voltage reference configured to generate a first current through a first resistor; a second voltage reference configured to generate a second current; a first current mirror configured to subtract the second current from the first current to generate a temperature invariant current; a third voltage reference configured to generate a third current via a second resistor; and a second current mirror configured to: subtract the temperature invariant current from the third current to produce a process-temperature invariant current, and output the process-temperature invariant current.

20 Claims, 2 Drawing Sheets

(56) References Cited

U.S. PATENT DOCUMENTS

| | | | | |
|---|---|---|---|---|
| 7,852,061 | B2 | 12/2010 | Liu et al. | |
| 8,154,272 | B2 | 4/2012 | Kim et al. | |
| 8,754,700 | B1 * | 6/2014 | Ro | H03D 7/1491 327/359 |
| 2003/0001660 | A1 * | 1/2003 | Yang | G05F 3/245 327/540 |
| 2003/0080807 | A1 * | 5/2003 | Dasgupta | G05F 3/30 327/543 |
| 2004/0151023 | A1 * | 8/2004 | Khouri | G11C 7/04 365/163 |
| 2005/0030109 | A1 * | 2/2005 | Kim | H03K 3/011 331/16 |
| 2007/0273352 | A1 * | 11/2007 | Lee | G05F 3/30 323/315 |
| 2015/0043600 | A1 * | 2/2015 | Ying | H01S 5/06804 372/38.02 |

OTHER PUBLICATIONS

Shinde, "PVT Insensitive IREF Generation", Proceedings of the International MultiConference of Engineers and Computer Scientists, 2014 vol. II, IMECS 2014, pp. 690-694.

Bendali et al, "A 1-V CMOS Current Reference With Temperature and Process Compensation", IEEE Transactions on Circuits & Systems—I:Regular Papers, vol. 54, 2007, pp. 1424-1429.

Gregorie et al, "Process-Independent Resistor Temperature-Coefficients using Series/Parallel and Parallel/Series Composite Resistors", ISCAS 2007, 2007, pp. 2826-2829.

Kim et al, "PVT Variation Tolerant Current Source With On-Chip Digital Self-Calibration", IEEE Transactions on VLSI Systems, vol. 20, No. 4, 2012, pp. 737-741.

Tang et al, "Temperature & Process Invariant MOS-based Reference Current Generation Circuits for Sub-1V Operation", Proceedings of the 2003 ISLPED, 2003, pp. 199-204.

* cited by examiner

PRECISION CURRENT REFERENCE GENERATOR CIRCUIT

FIELD OF THE INVENTION

The invention relates to current reference generators, and more particularly, to current reference generators that mix currents to generate a reference current with relatively low temperature and process coefficients.

BACKGROUND

A current reference circuit is an essential part of an autonomous Input/Output (I/O) limited integrated circuit. An approach to generate a stable current is to employ an external (e.g., off-chip) precision resistor and produce a fixed voltage across this resistor through internal (e.g., on-chip) circuitry. Off-chip resistors are used since on-chip resistors suffer from relatively large (e.g., 20-30%) tolerances and therefore are not very suitable for generating a stable reference current using this technique. In certain I/O-limited applications, current variations in a simplistic on-chip current reference circuit due to process voltage temperature (PVT) variations lead to specification violation or functional failure.

With complementary metal-oxide semiconductor (CMOS) processes in the deep submicron regime, second-order effects (e.g., drain-induced-barrier-lowering) have reduced transistors intrinsic drain-to-source resistance and have pushed transistors towards highly non-ideal current source behaviors. A temperature compensation technique includes generating a proportional to absolute temperature (PTAT) and a complementary to absolute temperature (CTAT) current and adding them up to achieve a smaller temperature coefficient. This, however, does not address process variations, which are especially problematic for deep submicron technologies.

Another technique to address temperature compensation is based on passively mixing components having opposite temperature and process coefficients. This approach, however, provides a very limited freedom as different components have different geometrical and structural issues. Also, this approach leads to further issues of reducing sensitivities without adding any extra fabrication or structural sensitivities.

SUMMARY

In an aspect of the invention, a current reference generator includes a first voltage reference configured to generate a first current through a first resistor; a second voltage reference configured to generate a second current; and a first current mirror configured to subtract the second current from the first current to generate a temperature invariant current.

In an aspect of the invention, a system comprises: a first voltage reference configured to generate a first current through a first resistor; a second voltage reference configured to generate a second current; a first current mirror configured to mix the first current and second current to generate a temperature invariant current; a third voltage reference configured to generate a third current via a second resistor; and a second current mirror configured to: mix the third current and the temperature invariant current to produce a process-temperature invariant current, and output the process-temperature invariant current.

In an aspect of the invention, a system comprises: a current reference generator configured to output a current-temperature invariant current.

BRIEF DESCRIPTION OF THE DRAWINGS

The present invention is described in the detailed description which follows, in reference to the noted plurality of drawings by way of non-limiting examples of exemplary embodiments of the present invention.

DETAILED DESCRIPTION

The invention relates to current reference generators, and more particularly, to current reference generators that mix currents to generate a reference current with relatively low temperature and process coefficients. Aspects of the present invention provide a process voltage temperature (PVT) tolerant compensated precision current reference for application specific integrated circuits. In embodiments, the precision current reference generator exhibits relatively smaller scattering in bias current value for PVT variations without needing an external precision resistor.

In embodiments, the current reference generator circuit mixes three different temperature and process coefficients with a relatively high-degree of insulation from supply voltage to considerably reduce the current variations in the output bias current. In embodiments, the circuit may mix and match different sets of temperature and process coefficients available within a process design kit (e.g., design libraries).

As described herein, the current reference generator circuit first subtracts two currents to achieve a near zero temperature coefficient but still with a large process coefficient. Another current is generated which natively has a relatively small temperature coefficient. This current is mixed with the difference of the previous two current to minimize the process coefficient. The currents are generated in a manner such that they are isolated from the power supply using components of a relatively high impedance, therefore, also achieving voltage tolerance. In this manner, complete PVT tolerance is achieved across all process corners.

As described herein, three currents are employed in generating the reference current:

- Current $I_1$—a PTAT (proportional to absolute temperature) current coming from a polysilicon resistor with a high sheet resistance;
- Current $I_2$—a PTAT current coming from the closed loop bandgap of the IC; and
- Current $I_3$—another PTAT coming from a polysilicon resistor with low sheet resistance.

Figure 1:
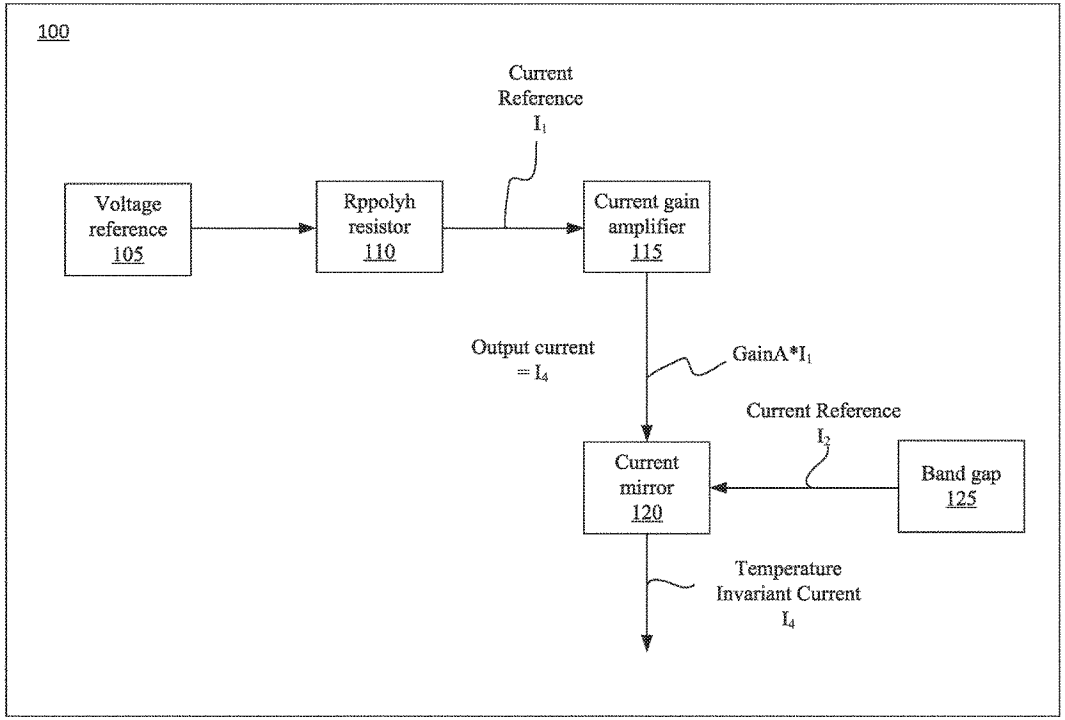
FIG. 1 shows an example circuit for generating a temperature invariant current in accordance with aspects of the present invention.

FIG. 1 shows an example circuit 100 for generating a temperature invariant current in accordance with aspects of the present invention. As described herein, a temperature invariant current is generated by subtracting two currents to achieve a near zero temperature coefficient but still with a large process coefficient. For example, currents $I_1$ and $I_2$ are subtracted by a current mirror 120, and the resulting current is a temperature invariant current (e.g., a temperature current with a near zero temperature coefficient).

As shown in FIG. 1, a voltage reference 105 provides a voltage across an rppolyh resistor 110. As described herein, the voltage reference 105 may provide the voltage when activated (e.g., connected to a voltage source). The voltage reference 105 may be activated using any number of techniques and at any time based on a desired application.

The rppolyh resistor 110 (also referred to as an rphpoly resistor) may include a precision P+ polysilicon resistor without salicide. The current output after the voltage is provided through the rppolyh resistor 110 is a current reference, referred to as $I_1$. The current reference $I_1$ may be proportional to an absolute temperature (PTAT) current that is generated from the rppolyh resistor 110. As further shown in FIG. 1, a current reference $I_2$ is provided by a band gap 125. The band gap 125 may include a closed loop band gap voltage reference. The band gap 125 may be activated using any number of techniques and at any time based on a desired application.

As an illustrative, non-limiting example, the temperature and process coefficients can be used to express currents $I_1$ and $I_2$ as following for a particular bias point.

$$I_1(T,p)=97.8809+p*103.8716+T*(0.2638408+p*0.2888912) \quad (1)$$

$$I_2(T,p)=88.6093+p*37.4134+T*(0.3816264+p*0.161782) \quad (2)$$

where T is absolute temperature, p is process coefficient (0 for min corner and 1 for max corner).

While particular values are provided in the above example, in practice, the values may vary based on the properties of the rppolyh resistor 110 and of the band gap 125. That is, the values may be known based the known properties of the rppolyh resistor 110 and of the band gap 125.

The current reference $I_1$ is provided to a current gain amplifier 115, which applies a gain A to the current reference $I_1$. As described herein, the gain A is applied in order to match the temperature coefficients of $I_1$ and $I_2$ such that when the currents $I_2$ and gainA*$I_1$ are subtracted, the resulting current is a temperature invariant current.

In embodiments, the gain A is based on the properties and attributes of the rppolyh resistor 110 and of the band gap 125. For example, to determine the gain A, the temperature coefficients of $I_1$ and $I_2$ are matched, and the difference of the currents $I_1$ and $I_2$ is taken (e.g., using equation 3 below).

$$\delta/\delta T(A*I_1-I_2)=0 \quad (3)$$

Solving the partial derivate by substituting $I_1$ in equation 3 with $I_1$ in equation 1, and substitution $I_2$ in equation 3 with $I_2$ in equation 2 produces the result:

$$97.8809*A*(0.0026955+0.00295154*p)-88.6093*(0.004306+0.0018258*p)=0 \quad (4)$$

Equation 4 is then solved with respect to A for both process corners (e.g., when p=0 and p=1). Solving equation 4 for A when p=0 produces the result:

$$A=1.4461 \quad (5)$$

Solving equation 4 for A when p=1 produces the result:

$$A=0.9830 \quad (6)$$

In embodiments, the two values for A may be averaged in order to ensure that the current change over temperature is minimal for both process corners. Averaging the values for A as shown in equations 5 and 6 produce the result:

$$A=1.21455 \quad (7)$$

The amplified current (e.g., the current GainA*$I_1$) is subtracted from the current reference $I_2$ to produce the output current $I_4$. For example, the current GainA*$I_1$ and the current reference $I_2$ are mixed (e.g., subtracted) by a current mirror 120, as shown in FIG. 1. The output current $I_4$ is a process dependent temperature invariant current (e.g., a current with a relatively high process coefficient, and a relatively low temperature coefficient). As described herein, the output current $I_4$ is later used to produce a temperature-process invariant current. For example, the output current $I_4$ is mixed with another current which natively has a smaller temperature coefficient to minimize the process coefficient. As an illustrative, non-limiting example, the temperature and process coefficients can be used to express currents $I_4$ as follows for a particular bias point:

$$I_4(T,p)=28.84778+87.234606*p-T*(0.06494-p*0.1848799 \quad (8)$$

where T is absolute temperature, p is process coefficient (0 for min corner and 1 for max corner).

Figure 2:
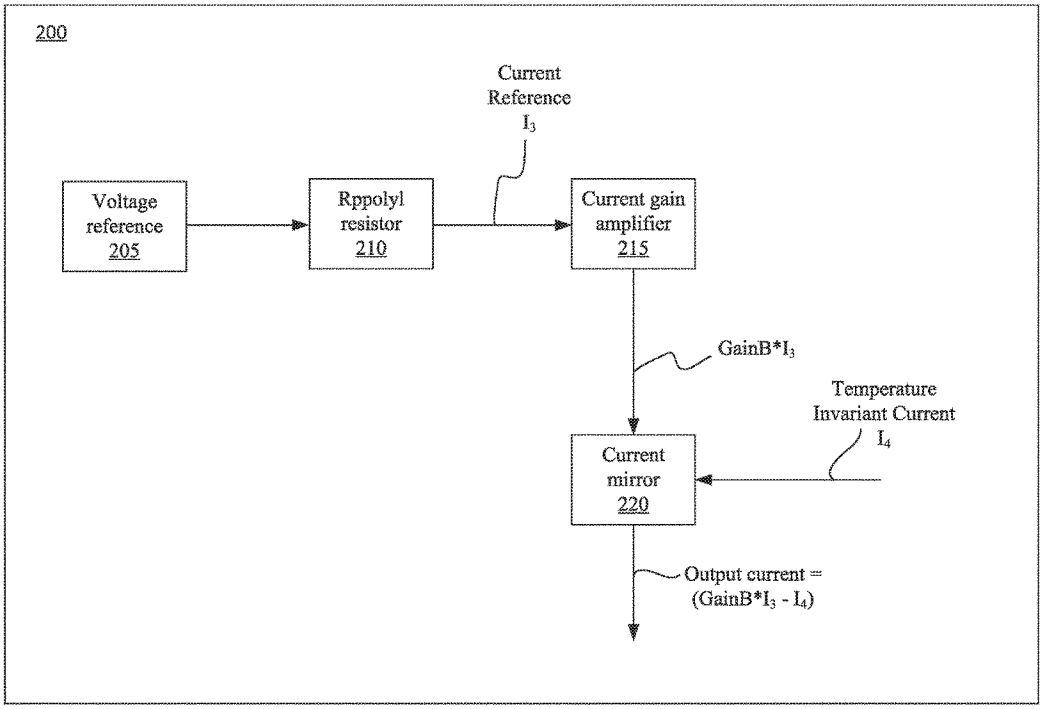
FIG. 2 shows an example circuit for generating a process-temperature invariant current in accordance with aspects of the present invention.

FIG. 2 shows an example circuit 200 for generating a process-temperature invariant current in accordance with aspects of the present invention. As described herein, generating the process-temperature invariant current (e.g., a current that is invariant over both process and temperature) involves matching the process coefficient of a low-resistance poly temperature invariant current with the current generated in the circuit 100 of FIG. 1.

As shown in FIG. 2, a voltage reference 205 is supplied across an rppolyl resistor 210. The rppolyl resistor 210 (also referred to as an rplpoly resistor) may include a precision P+ polysilicon resistor with salicide. The salicide is provided to reduce the sheet resistance. Thus, the current output after the voltage is provided through the rppolyl resistor 210 (referred to as $I_3$) is provided by a resistor with a lower sheet resistance than the current $I_1$ provided by the rppolyh resistor 110 such that the current $I_3$ natively has a relatively small temperature coefficient. The voltage reference 205 may be activated using any number of techniques and at any time based on a desired application.

As an illustrative, non-limiting example, the temperature and process coefficients can be used to express current $I_3$ as following for a particular bias point.

$$I_3(T,p)=28.0352+p*11.97+T*(0.00492944+p*0.00386) \quad (9)$$

While particular values are provided in the above example, in practice, the values may vary based on the properties of the rppolyl resistor 210. That is, the values may be known based the known properties of the rppolyl resistor 210.

The current $I_3$ is provided to a current gain amplifier 215, which applies a gain B to the current $I_3$. As described herein, the gain B is applied in order to match the process coefficient of $I_4$ (e.g., the temperature invariant current produced by the circuit 100 of FIG. 1) such that when the currents $I_4$ and gainB*$I_3$ are subtracted, the resulting current is a temperature-process invariant current. The gain B is determined by matching the process coefficient of $I_3$ with current $I_4$ generated previously as described with respect to FIG. 1. For example, equation 10, shown below, may be used to determine the gain B $$\delta/\delta p(B*I_3-I_4)=0 \quad (10)$$

Substituting $I_3$ in equation 10 with $I_3$ in equation 9 and $I_4$ in equation 10 with $I_4$ in equation 8 and subsequently solving the partial derivate of equation 10 produces the following result:

$$B*(11.9699+0.0038599*T)-87.234606+0.1848799*T=0 \quad (11)$$

Setting T=0 in equation 11 to eliminate the temperature coefficient and solving for B yields the result:

$$B=7.2878 \quad (12)$$

The current $I_4$ (which is the temperature-invariant current produced by the circuit 100 of FIG. 1) is mixed with (e.g., subtracted from) the current gain$B*I_3$ using a current mirror 220. The resulting output current is gain$B*I_3-I_4$ which is a process-temperature invariant current in which both the process and temperature currents are minimized.

As described herein, aspects of the present invention may mix different components to nullify temperature and process coefficients. However, instead of performing mixing and matching passively, aspects of the present invention generate currents from each component and subsequently mix the currents using an active current-mirroring technique. The current-mirroring allows the circuit to have a large of current-ratio(s) so that the three different currents can be mixed with the optimally required coefficients in a power and area efficient manner. Due to its active nature, this approach itself consumes a particular amount of power to achieve a relatively high-accuracy current matching.

As described herein, the current reference generator, in accordance with aspects of the present invention, include the circuit 100 of FIG. 1 and the circuit 200 of FIG. 2. The current reference generator may include a first voltage reference (e.g., the voltage reference 105 of FIG. 1), a second voltage reference (e.g., the band gap 125 of FIG. 1), a first resistor (e.g., the rppolyh resistor 110 of FIG. 1), a first current mirror (e.g., the current mirror 120 of FIG. 1), a third voltage reference (e.g., the voltage reference 205 of FIG. 2), a second resistor (e.g., the rppolyl resistor 210 of FIG. 2), a second current mirror (e.g., the current mirror 220 of FIG. 2), a first current gain amplifier (e.g., the current gain amplifier of 115 of FIG. 1), and a second gain amplifier (e.g., the current gain amplifier 215 of FIG. 2). Accordingly, the circuit 100 of FIG. 1 and the circuit 200 of FIG. 2 may be integrated into a single circuit to provide the advantages described herein. The activation of the voltage reference 105, the band gap 125, and the voltage reference 205 subsequently produces the output process-temperature invariant current as shown and described with respect to FIGS. 1 and 2.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed:

1. A current reference generator comprising:

a first voltage reference configured to generate a first current through a first resistor;

a second voltage reference configured to generate a second current;

a first current mirror configured to subtract the second current from the first current to generate a temperature invariant current;

a third voltage reference configured to generate a third current; and a second current mirror configured to:

subtract the temperature invariant current from the third current to produce a process-temperature invariant current, and output the process-temperature invariant current.

2. The current reference generator of claim 1, further comprising a current gain amplifier configured to apply a gain to the first current, wherein the gain is based on temperature coefficients of the first current and the second current.

3. The current reference generator of claim 2, wherein subtracting the second current from the first current to generate the temperature invariant current includes subtracting the second current from the first current with the applied gain.

4. The current reference generator of claim 1, wherein the third current is generated via a second resistor.

5. The current reference generator of claim 4, further comprising a current gain amplifier configured to apply a gain to the third current, wherein the gain is based on a process coefficient of the temperature invariant current.

6. The current reference generator of claim 5, wherein subtracting the temperature invariant current from the third current to produce the process-temperature invariant current includes subtracting the temperature invariant current from the third current with the applied gain.

7. The current reference generator of claim 4, wherein the first resistor is an rppolyh resistor and the second resistor is an rppolyl resistor.

8. The current reference generator of claim 4, wherein the first resistor has a higher sheet resistance than the second resistor.

9. The current reference generator of claim 4, wherein the second resistor includes a salicide.

10. A system comprising:

a first voltage reference configured to generate a first current through a first resistor;

a second voltage reference configured to generate a second current;

a first current mirror configured to mix the first current and second current to generate a temperature invariant current;

a third voltage reference configured to generate a third current via a second resistor; and a second current mirror configured to:

mix the third current and the temperature invariant current to produce a process-temperature invariant current, and output the process-temperature invariant current.

11. The system of claim 10, further comprising a gain amplifier configured to apply a gain to the first current, wherein the gain is based on temperature coefficients of the first current and the second current.

12. The system of claim 11, wherein mixing the first and second currents to generate the temperature invariant current includes subtracting the second current from the first current with the applied gain.

13. The system of claim 10, further comprising a gain amplifier configured to apply a gain to the third current, wherein the gain is based on a process coefficient of the temperature invariant current.

14. The system of claim 13, wherein mixing the third current and the temperature invariant current to produce the process-temperature invariant current includes subtracting the temperature invariant current from the third current with the applied gain.

15. The system of claim 10, wherein the first resistor is an rppolyh resistor and the second resistor is an rppolyl resistor.

16. The system of claim 10, wherein the first resistor has a higher sheet resistance than the second resistor.

17. The system of claim 10, wherein the second resistor includes a salicide.

18. A system comprising:

a current reference generator configured to output a process-temperature invariant current, wherein the current reference generator is configured to:

generate a first current;

generate a second current;

subtract the first current and second current to generate a temperature invariant current;

generate a third current;

subtract the third current and the temperature invariant current to produce the process-temperature invariant current; and output the process-temperature invariant current.

19. The system of claim 18, wherein the current reference generator is further configured to:

generate the first current through a first resistor; and generate the third current via a second resistor.

20. The system of claim 19, wherein the first resistor is an rppolyh resistor and the second resistor is an rppolyl resistor.

* * * * *